US009408450B2

(12) United States Patent
Schlipper

(10) Patent No.: US 9,408,450 B2
(45) Date of Patent: Aug. 9, 2016

(54) REINFORCED TEXTILE CARRYING STRAP

(71) Applicant: MRM HK LIMITED, Hong Kong (HK)

(72) Inventor: Robert Wesley Schlipper, Hong Kong (HK)

(73) Assignee: MRM HK LIMITED, Hong Kong (HK)

( * ) Notice: Subject to any disclaimer, the term of this patent is extended or adjusted under 35 U.S.C. 154(b) by 384 days.

(21) Appl. No.: 13/864,215

(22) Filed: Apr. 16, 2013

(65) Prior Publication Data

US 2013/0276941 A1 Oct. 24, 2013

(30) Foreign Application Priority Data

Apr. 17, 2012 (AU) ..... 2012901510

(51) Int. Cl.
*A45C 13/30* (2006.01)
*A45F 3/14* (2006.01)

(52) U.S. Cl.
CPC .. *A45C 13/30* (2013.01); *A45F 3/14* (2013.01)

(58) Field of Classification Search
CPC ..... A45C 13/30; A45C 3/14; A45C 13/26
See application file for complete search history.

(56) References Cited

U.S. PATENT DOCUMENTS 946,656 A * 1/1910 Cole ..... 2/338
2,064,781 A 12/1936 Collins
2,194,038 A 3/1940 Wallace, Jr.
2,245,095 A * 6/1941 Nordseth ..... 139/384 R
2,279,206 A * 4/1942 Randall ..... 139/384 R
2,659,958 A 11/1953 Henry
2,941,914 A 6/1960 Ouimet
3,013,919 A 12/1961 Bialy Michael
RE26,704 E * 11/1969 Norton ..... 294/74
3,875,771 A 4/1975 Reisner
3,908,571 A 9/1975 Motsenbocker
4,018,960 A 4/1977 Berger et al.
4,148,957 A 4/1979 Berger et al.
4,174,738 A 11/1979 Berger et al.
4,209,044 A 6/1980 Taki
4,233,713 A 11/1980 Berg
4,600,626 A 7/1986 Ogata
4,640,179 A 2/1987 Cameron
4,856,837 A 8/1989 Hammersla et al.
5,018,652 A * 5/1991 Holtzclaw, Jr. ..... 224/150
5,181,638 A 1/1993 McHale
5,183,703 A 2/1993 Berger et al.
5,219,636 A 6/1993 Golz (Continued)

FOREIGN PATENT DOCUMENTS

CN 103373578 A 10/2013
EP 1688059 B1 8/2006

(Continued)

OTHER PUBLICATIONS

European Search Report issued in EP Application No. 13002004.3, mailed Jul. 9, 2013, 5 pages.

*Primary Examiner* — Tri Mai
(74) *Attorney, Agent, or Firm* — Faegre Baker Daniels LLP

(57) ABSTRACT

A carry-strap assembly for supporting a bag is reinforced, as by elongate members such as wire cables for security. An elongate recess with a mouth is integrally formed within a textile strap adjacent a longitudinal edge of the strap. Adjacent strips of the strap are fastened to close the elongate recess within which the elongate reinforcing member is received.

14 Claims, 2 Drawing Sheets

(56) References Cited

U.S. PATENT DOCUMENTS

| | | | | |
|---|---|---|---|---|
| 5,343,897 | A * | 9/1994 | Sakatani et al. | 139/384 R |
| 5,415,449 | A | 5/1995 | Kentner et al. | |
| 5,419,951 | A | 5/1995 | Golz | |
| 5,436,044 | A | 7/1995 | Pinkos | |
| 5,498,047 | A | 3/1996 | Treuling | |
| 5,655,358 | A | 8/1997 | Kolmes | |
| 5,660,312 | A | 8/1997 | Suzuki | |
| 5,730,347 | A | 3/1998 | Finot | |
| 5,860,769 | A | 1/1999 | Seligman | |
| 6,026,662 | A | 2/2000 | Schlipper | |
| 6,199,412 | B1 | 3/2001 | Kennedy | |
| 6,244,081 | B1 | 6/2001 | Schlipper | |
| 6,510,717 | B1 | 1/2003 | Levi | |
| 6,626,335 | B1 | 9/2003 | Dunlop | |
| 6,802,442 | B1 | 10/2004 | Thompson | |
| 7,454,932 | B2 | 11/2008 | Hollier | |
| 7,721,518 | B2 | 5/2010 | Danzey | |
| 7,926,859 | B2 | 4/2011 | St. Germain | |
| 8,079,387 | B2 * | 12/2011 | Goering et al. | 139/11 |
| 8,127,802 | B2 * | 3/2012 | Ouellette et al. | 139/11 |
| 8,267,290 | B2 | 9/2012 | Schlipper | |
| 2002/0129628 | A1 | 9/2002 | Skalberg | |
| 2003/0010801 | A1 | 1/2003 | Schlipper | |
| 2003/0110818 | A1 | 6/2003 | Schlipper | |
| 2005/0005343 | A1 | 1/2005 | Johnson | |
| 2005/0278901 | A1 | 12/2005 | Huang | |
| 2006/0032883 | A1 | 2/2006 | Moreno et al. | |
| 2007/0240798 | A1 | 10/2007 | Bihler | |
| 2007/0251279 | A1 | 11/2007 | Hollier | |
| 2008/0156835 | A1 | 7/2008 | Schlipper | |
| 2009/0140020 | A1 * | 6/2009 | Schlipper | 224/257 |
| 2010/0243114 | A1 | 9/2010 | Hai et al. | |
| 2011/0059325 | A1 | 3/2011 | Juan et al. | |
| 2011/0088987 | A1 * | 4/2011 | Santy et al. | 190/115 |
| 2012/0138403 | A1 * | 6/2012 | Tong | 190/18 A |

FOREIGN PATENT DOCUMENTS

| | | | |
|---|---|---|---|
| EP | 1941812 | A1 | 7/2008 |
| EP | 2064967 | A2 | 6/2009 |
| EP | 2653056 | A1 | 10/2013 |
| WO | 2005118990 | A1 | 12/2005 |

* cited by examiner

REINFORCED TEXTILE CARRYING STRAP

TECHNICAL FIELD

The present invention relates to a textile carrying strap for a bag, which is reinforced, as by wires, for security.

BACKGROUND OF THE INVENTION

The use of steel wire cable, or like reinforcements, in the construction of flexible carrying straps for baggage provides an increased level of security against theft, particularly that achieved by slicing the strap. A prior art design employs two elongate wire cables to reinforce carrying straps of this type, the wire cables running longitudinally and received in fabric sleeves, formed by folding and sewing one or more panels, with the sleeves extending along opposing edges of a textile strap. Enveloping the wires within separate elongate envelopes that are connected by seams to the textile strap keeps the wires separated, helping the strap lie flat in use and avoiding one wire overlying another in a manner which may cause discomfort and localised wear on the envelope. It will be understood that although this prior art design also allows the straps to be readily manufactured using conventional sewing techniques, the number of separate parts and manufacturing steps required tends to increase the manufacturing costs in straps of this type. It is an object of the present invention to overcome or substantially ameliorate the above disadvantages, or more generally to provide an improved reinforced textile carrying strap.

DISCLOSURE OF THE INVENTION

According to one aspect of the present invention there is provided a carry-strap assembly for supporting a bag, the carry-strap assembly comprising:

a textile strap having a width substantially greater than its thickness, at least one elongate recess integral with the textile strap and disposed adjacent a longitudinal edge, the recess having a mouth, fastening means joining adjacent strips of the textile strap to close the mouth, and an elongate flexible reinforcing member received within the recess.

The textile strap is preferably the principal load-carrying member for supporting the weight of the bag, and the flexibility of the textile strap allows it conform to the user's body. As a strap it generally has a constant cross-section throughout its length, being broad to spread the weight being carried. The textile strap is preferably woven, but it may alternatively may be braided or knitted. Preferably the textile strap is woven from natural and/or synthetic threads. The synthetic threads may include heat fusible synthetic threads. Preferably the at least one recess includes one recess integrally formed in each of the opposing longitudinal edges of the textile strap, each recess having a mouth, fastening means joining adjacent strips of the textile strap to close each mouth and form an elongate recess adjacent each longitudinal edge of the textile strap, and an elongate flexible reinforcing member received within each recess.

The flexible reinforcing members serve to reinforce the carry-strap assembly against cutting, particularly being cut by a blade and may be wire cables, such as multi-stranded twisted wire cables. Alternatively, other reinforcing members may be used, such as composite multifilament threads made, for instance, of para-aramid fibres or carbon nanotubes.

Preferably the multi-stranded twisted wire cables are sheathed or coated with plastic, or with a similar material.

Preferably the fastening means comprises stitches, preferably forming continuous longitudinal seams. Optionally, the fastening means may comprise adhesive or heat bonding resulting from fusing synthetic threads in the textile strap. In this manner the flexible reinforcing members may be able to move within each recess, or else they may be fixed to the textile strap.

Preferably the carry-strap assembly further comprises a pair of flaps formed on each of the opposing longitudinal edges integrally with a central section of the strap, the fastening means securing strips of the flaps adjacent the longitudinal edges of the flaps of each pair together to thereby form the elongate recess between each pair of flaps. Preferably the flaps have like width.

Preferably the textile strap is a three-layer woven textile, comprising an intermediate layer disposed between, and interwoven with, two external layers, the flaps comprising edge portions of each of the two external layers that project from the edges of the intermediate layer.

Preferably each of the layers comprises a respective array of warp threads, and a first weft thread fills a first of the external layers and also extends only about the warp threads of the intermediate layer, and a second weft thread fills a second of the external layers and also extends only about the warp threads of the intermediate layer.

Alternatively, the textile strap may be formed from a flattened tubular braid, the fastening means securing strips of the textile strap inboard of the recess.

Couplers may be fixed to the carry-strap assembly and the bag respectively, allowing the carry-strap assembly to be disconnected from the bag. Alternatively, the carry-strap assembly may be permanently fixed to the bag.

This invention provides a reinforced carry-strap assembly which is effective and reduces the number of parts and manufacturing procedures, and can thus be produced at lower cost than prior art straps of this type.

In another aspect the invention provides a method of manufacturing the carry-strap assembly described above, wherein the elongate flexible reinforcing member is inserted into the recess before the fastening means joins adjacent strips of the strap to close the mouth.

BRIEF DESCRIPTION OF THE DRAWINGS

Preferred forms of the present invention will now be described by way of example with reference to the accompanying drawings, wherein.

DESCRIPTION OF THE PREFERRED EMBODIMENTS

Figure 1:
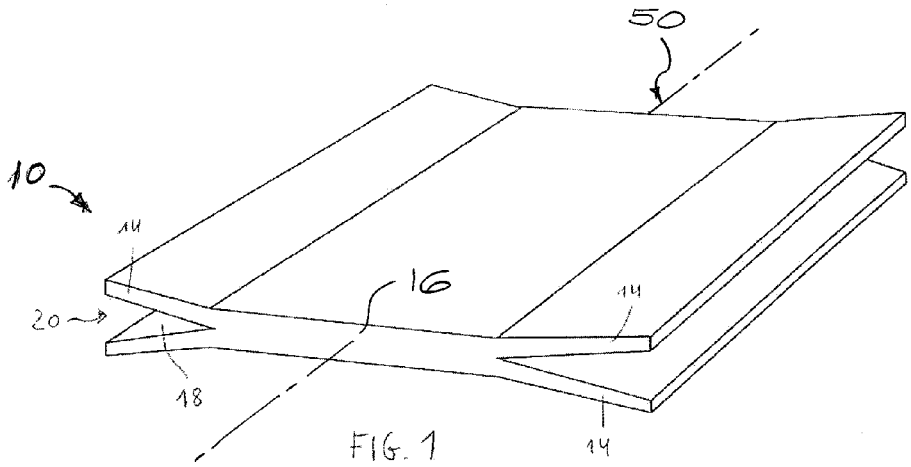
FIG. 1 is a schematic perspective view of a length of a textile strap for forming a reinforced carry-strap assembly according to a preferred embodiment of the invention.
Figure 2:
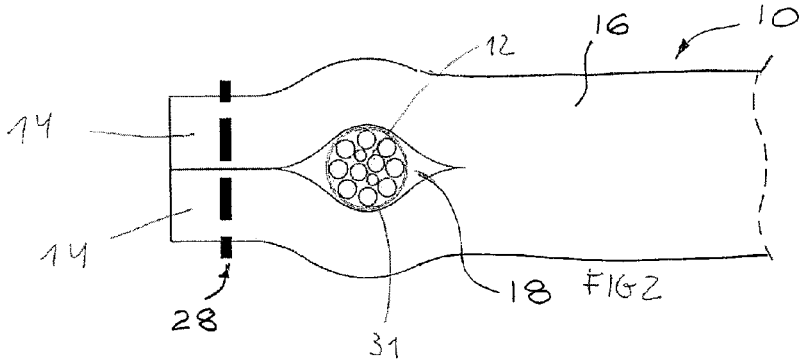
FIG. 2 is a partial cross section through an edge of a reinforced carry-strap assembly according to an embodiment of the invention.
Figure 3:
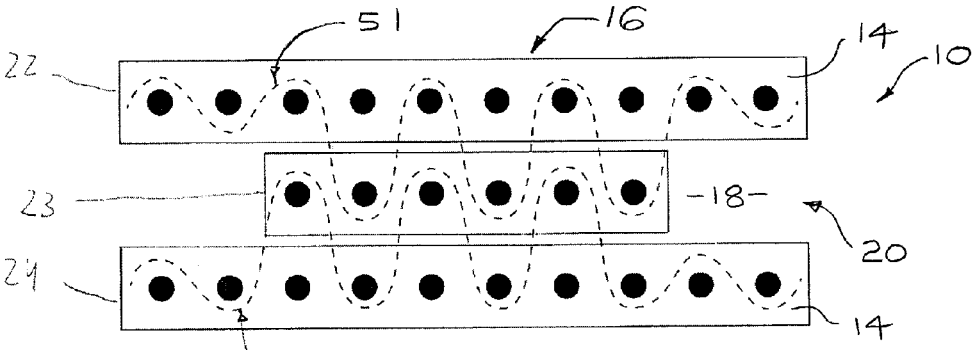
FIG. 3 is a schematic cross-sectional view of the weave of the three layers of the reinforced strap of FIGS. 1 and 2.

Referring to the drawings, FIGS. 1-3 illustrate a preferred embodiment of a carry-strap assembly of the invention, which generally comprises a textile strap 10 and a pair of elongate flexible reinforcing members, such as multi-stranded twisted wire cables 12 disposed in elongate recesses 18 near the edges of the textile strap 10.

The illustrated textile strap 10 is of one piece woven construction, having generally constant cross-section throughout its length. It is generally oblong in cross-section, having a width substantially greater than its thickness. The form of the textile strap 10 is generally symmetrical, having rotational symmetry about a central longitudinal axis 50. A pair of flaps 14 of like dimension are formed on the opposing edges of the textile strap 10, projecting from a central section 16, and defining the recesses 18. Each recess 18 has an elongate mouth 20 extending along the edge of the textile strap 10. The mouth 20 is shown open in FIGS. 1 and 3, and closed in FIG. 2. The textile strap 10 may be a three-layer textile, comprising an intermediate layer 23 disposed between, and interwoven with, two external layers 22, 24. The intermediate layer 23 generally extends for the width of the central section 16, and serves to increase the thickness of the central section 16 compared to the thickness of the flaps 14. The flaps 14 may be edge portions of each of the two external layers 24 that project from the edges of the intermediate layer 23. Each of the layers 22, 23, 24 may comprise a respective array 55, 56, 57 of warp threads, represented in FIG. 2 by the three parallel, linear arrays of circles. Two weft threads 51, 52 (shown in dashed lines) may complete the weave. Each weft thread 51, 52 fills a respective one of the external layers 22, 24. In addition to filling the layer 22 the weft thread 51 also extends only about the warp threads of the intermediate layer 23, and not about the warp threads of the other external layer 24. Likewise, in addition to filling the layer 24 the weft thread 52 also extends only about the warp threads of the intermediate layer 23, and not about the warp threads of the other external layer 22. In this manner the weft threads 52 also serve to integrate the three layers 22-24 to produce a strong but flexible strap, with flaps 14 which are less than half the thickness of the central portion 16. The wire cables 12 may each have a plastic coating 31 which serves to provide a smooth outer surface to the cables 12 and to bind together the individual wire strands. The wire cables 12 are received and enclosed within the elongate recesses 18 between each pair of flaps 14. Stitches forming continuous longitudinal seams 28 secure together strips of the flaps 14 adjacent the longitudinal edges of the flaps 14 to thereby close the mouth 20 of each recess 18.

Figure 5:
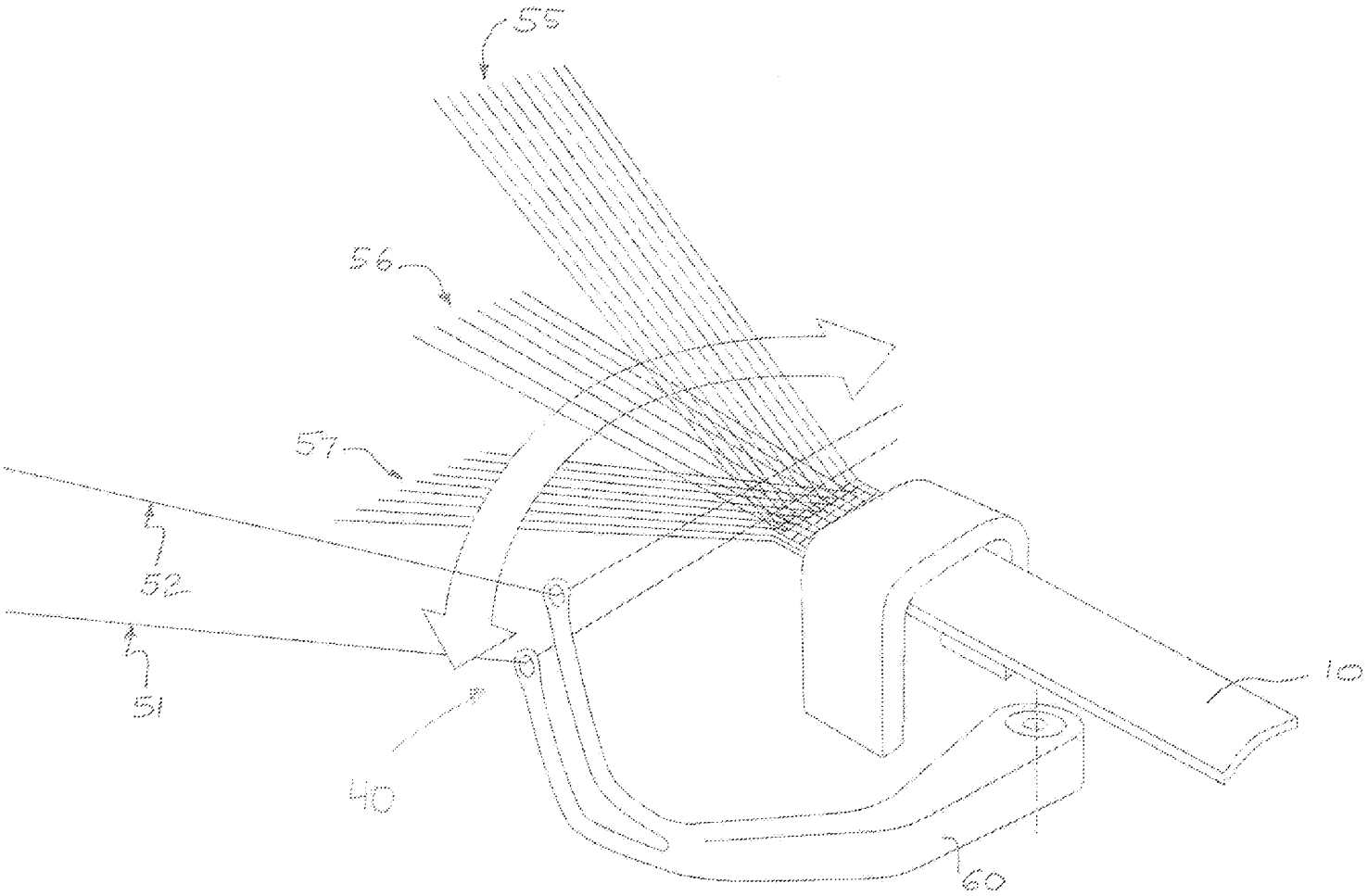
FIG. 5 is a schematic perspective view of a loom for weaving the textile strap of the invention.

To manufacture the carry-strap assembly, the textile strap 10 may first be woven, before the wire cables 12 are inserted in the recesses 18, and the flaps 14 are sewn together to enclose the wire cables 12. FIG. 5 schematically illustrates a loom 40 which may be used to weave the three-layer textile strap 10, and includes a picking arm 60 with an eyes through which each of the weft threads 51, 52 are run, and which shuttles back and forth transversely. In the preferred embodiment of FIGS. 1 to 3, it is advantageous to insert the cables 12 into the recesses 18 before sewing the seams 18, avoiding the need to insert the cable 12 longitudinally.

Figure 4:
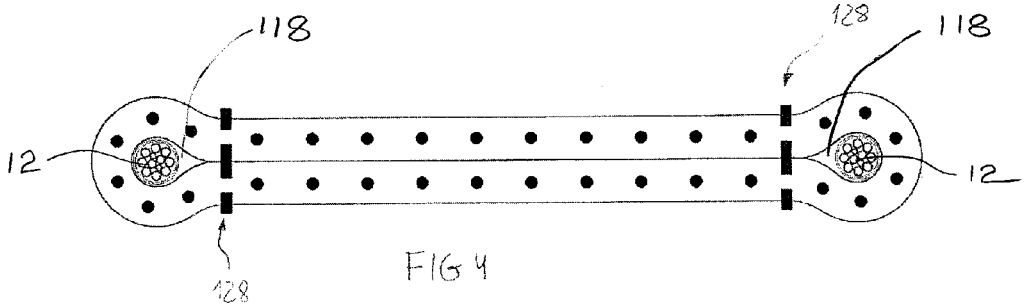
FIG. 4 is a cross-sectional view of an alternative embodiment of a reinforced carry-strap assembly according to the invention.

In an alternative embodiment shown in FIG. 4, the textile strap is a tubular braid that is flattened so as to form an elongate recess 118 along each edge of the textile strap. The seams 128 secure together the strips inboard of the recesses 118, to close the inwardly opening mouth of these internal recesses 118. The cables 12 are preferably inserted into the tubular braid before forming the seams 128.

Aspects of the present invention have been described by way of example only and it should be appreciated that modifications and additions may be made thereto without departing from the scope thereof.

The invention claimed is:

1. A carry-strap assembly for supporting a bag, the carry-strap assembly comprising:

a woven textile strap having a width substantially greater than its thickness, the textile strap having only three layers, the three layers consisting of a first external layer, a second external layer and an intermediate layer deposed between, and interwoven with, the first and second external layers;

a first pair of flaps formed along a first longitudinal edge of the strap and extending from a central portion of the strap;

a first elongate flexible reinforcing wire received within a first recess formed between the first pair of flaps and extending the longitudinal length of the textile strap, wherein the first pair of flaps are fastened to one another to enclose the first elongate flexible reinforcing wire within the first recess;

a second pair of flaps formed along a second longitudinal edge of the strap and extending from the central portion of the strap; and a second elongate flexible reinforcing wire received within a second recess formed between the second pair of flaps and extending the longitudinal length of the textile strap, wherein the second pair of flaps are fastened to one another to enclose the second elongate flexible reinforcing wire within the second recess, and wherein the first external layer, the second external layer and the intermediate layer each comprise an array of warp threads, and a first weft thread fills the first external layer and extends only about the warp threads of the first external layer and the intermediate layer, and a second weft thread fills the second external layer and extends only about the warp threads of the second external layer and the intermediate layer.

2. The carry-strap assembly of claim 1 wherein the textile strap is woven from natural threads, synthetic threads or a combination thereof.

3. The carry-strap assembly of claim 1 wherein the elongate flexible reinforcing wire is a multi-stranded twisted wire cable.

4. The carry-strap assembly of claim 3 wherein the multi-stranded twisted wire cable is coated with plastic.

5. The carry-strap assembly of claim 1 wherein the first flaps are fastened to one another by stitches, forming a continuous longitudinal seams.

6. The carry-strap assembly of claim 1 wherein the first pair of flaps have substantially the same width.

7. The carry-strap assembly of claim 1 wherein the first pair of flaps and the second pair of flaps form edge portions of the first and second external layers that project from the edges of the intermediate layer.

8. A method of manufacturing the carry-strap assembly of claim 1, wherein the first elongate flexible reinforcing wire is inserted into the first recess before the first pair of flaps are fastened to one another to enclose the first elongate flexible reinforcing wire within the first recess.

9. The carry-strap assembly of claim 1 wherein the assembly is free of a single weft thread extending about the warp threads of both the first external layer and the second external layer.

10. A carry-strap assembly for supporting a bag, the carry-strap assembly comprising:

a three-layer woven textile strap having opposing longitudinal edges and comprising only three layers consisting of an intermediate layer disposed between, and interwoven with, two external layers;

flaps comprising edge portions of each of the two external layers, such that a pair of flaps project from each edge of the intermediate layer, and an elongate recess is disposed between the flaps of each pair;

stitches joining the flaps of each pair to close the recess; and an elongate flexible reinforcing member received within each recess, wherein each of the intermediate layer and two external layers comprises a respective array of warp threads, and a first weft thread fills a first of the external layers and extends only about the warp threads of the first external layer and the intermediate layer, and a second weft thread fills a second of the external layers and extends only about the warp threads of the second external layer and the intermediate layer.

11. The carry-strap assembly of claim 10 wherein the assembly is free of a single weft thread extending about the warp threads of both external layers.

12. The carry-strap assembly of claim 10 wherein the elongate flexible reinforcing member is a multi-stranded twisted wire cable.

13. The carry-strap assembly of claim 12 wherein the multistranded twisted wire cable is coated with plastic.

14. The carry-strap assembly of claim 10 wherein the flaps of each pair have substantially the same width.

* * * * *